US008424817B1

(12) United States Patent
Chen

(10) Patent No.: US 8,424,817 B1
(45) Date of Patent: Apr. 23, 2013

(54) ARTICLE HOLDER

(76) Inventor: Mark Chen, Taichung (TW)

( * ) Notice: Subject to any disclaimer, the term of this patent is extended or adjusted under 35 U.S.C. 154(b) by 51 days.

(21) Appl. No.: 13/317,715

(22) Filed: Oct. 26, 2011

(51) Int. Cl.
*A46B 17/02* (2006.01)
*A47F 7/00* (2006.01)
*A47F 5/00* (2006.01)

(52) U.S. Cl.
USPC ..... 248/113; 248/110; 248/309.1; 211/70.6

(58) Field of Classification Search ..... 211/70.6, 211/66, 63, 106.1; 248/110, 113, 309.1, 248/311.2, 230.1, 206.2, 205.3, 305, 306, 248/341, 205.5, 682, 683, 685, 689, 690, 248/691, 565, 575, 590, 592, 594
See application file for complete search history.

(56) References Cited

U.S. PATENT DOCUMENTS 2,661,920 A 12/1853 Gochenour
3,265,032 A 8/1966 Hume
4,372,468 A 2/1983 Harvey
6,637,082 B1 10/2003 Chang
2003/0015638 A1* 1/2003 Yamada ..... 248/311.2

* cited by examiner

*Primary Examiner* — Jonathan Liu
*Assistant Examiner* — Erin W Smith
(74) *Attorney, Agent, or Firm* — Charles E. Baxley

(57) ABSTRACT

An article holder includes a base having a chamber and two opposite grooves, and having two ears, a follower having two projections slidably engaged with the grooves of the base and having a latching tongue, a carrier member having a pivot shaft extended from a protrusion and pivotally engaged with the ears of the base and having an engaging cavity, a spring member biases the latching tongue to engage with the engaging cavity of the carrier member at a working position, the carrier member is pivotal relative to the base to a storing position when the latching tongue of the follower is disengaged from the engaging cavity of the carrier member, a gripping block is pivotally attached to the carrier member and biased to engage with an article.

11 Claims, 9 Drawing Sheets

ARTICLE HOLDER

BACKGROUND OF THE INVENTION

1. Field of the Invention

The present invention relates to an article holder, and more particularly to an article holder including a ratchet engaging or retaining mechanism for stably or solidly engaging with the articles or tool members to be held and supported by the article holder and for allowing the articles or tool members to be easily and quickly secured or attached or mounted to the article holder and to be easily and quickly disengaged or detached from the article holder, and including a foldable structure for allowing the articles or tool members further to be easily and quickly secured or attached or mounted to the article holder.

2. Description of the Prior Art

Typical article holders comprise a number of spaced tool receiving recesses formed or defined by separated supporting walls for receiving or engaging with the fasteners or the articles or tool members that are to be held and supported by the article holder and that are arranged to be easily and quickly disengaged or detached from the article holder.

However, the tool members are simply clamped between the ridges or open loops such that the tool members may not be stably or solidly anchored or retained to the article holder and may have a good chance to be disengaged or detached from the article holder inadvertently.

The other typical article holders comprise one or more (such as two) spring biased cam horns or gripping blocks or clamp arms each equipped with frictional members or serrations at the free ends thereof for facilitating entry and removal of the articles or tool members.

For example, U.S. Pat. No. 3,265,032 to Hume, and U.S. Pat. No. 6,637,082 to Chang disclose several typical article holders each comprising one or more (such as two) spring biased cam horns or gripping blocks or clamp arms for facilitating the entry of a line between the cam elements upon movement of the line sideways radially of the line toward the nip of the cleat, thereby displacing the cam elements and enlarging the nip to receive and hold the line.

However, the typical article holders are normally solidly attached or mounted or secured to the wall members or supporting surfaces, but may not be folded relative to the wall members or supporting surfaces to the folding or storing position.

U.S. Pat. No. 2,661,920 to Gochenour discloses another typical article holder comprising a holding device pivotally or rotatably attached or mounted or secured to the wall members or supporting surfaces with a bracket for allowing the holding device to be pivoted or rotated relative to the wall members or supporting surfaces.

However, the holding device of the typical article holder may not be solidly and stably attached or mounted or anchored or secured or retained to the wall members or supporting surfaces at the selected angular position.

U.S. Pat. No. 4,372,468 to Harvey discloses a further typical article holder comprising a snap lock device including a tool support loop for securing and pivotally supporting a hammer or other similar tool from the user's waist belt.

However, the tool support loop of the typical article holder is extended out of the wall members or supporting surfaces and may not be folded relative to the wall members or supporting surfaces to the folding or storing position.

The present invention has arisen to mitigate and/or obviate the afore-described disadvantages of the conventional article holders for holding and supporting various tool members or articles.

SUMMARY OF THE INVENTION

The primary objective of the present invention is to provide an article holder including a ratchet engaging or retaining mechanism for stably or solidly engaging with the articles or tool members to be held and supported by the article holder and for allowing the articles or tool members to be easily and quickly secured or attached or mounted to the article holder and to be easily and quickly disengaged or detached from the article holder.

The other objective of the present invention is to provide an article holder including a foldable structure for allowing the articles or tool members further to be easily and quickly secured or attached or mounted to the article holder.

In accordance with one aspect of the invention, there is provided an article holder comprising a base including a chamber formed therein and opened downwardly, and including two opposite grooves formed therein and communicative with the channel of the base, and including two ears extended therefrom and each having an opening formed therein, a follower slidably engaged in the chamber of the base, and including two projections extended therefrom for slidably engaging with the grooves of the base and for limiting and guiding the follower to slide along the chamber of the base, and including a hand grip extended therefrom, and including a latching tongue extended therefrom, a carrier member including a protrusion extended therefrom for engaging into the chamber of the base, and including a pivot shaft extended from the protrusion and engaged through the openings of the ears of the base, and engaged into the ears of the base for pivotally mounting the carrier member to the base, and including an engaging cavity formed therein, the carrier member including a space formed therein and defined by a finger, a first spring biasing member engaged in the chamber of the base, and engaged between the base and the follower for biasing the follower toward the protrusion of the carrier member, and for forcing the latching tongue of the follower to selectively engage with the engaging cavity of the carrier member, and for selectively anchoring and retaining the carrier member to the base at a working position, the carrier member being allowed to be pivoted relative to the base to a storing position where the carrier member is in line with the base when the latching tongue of the follower is disengaged from the engaging cavity of the carrier member, a gripping block engaged in the space of the carrier member and pivotally attached to the carrier member with a pivot axle, and including a gripping portion for selectively engaging with an article, and a second spring biasing member engaged with the gripping block for biasing the gripping block to engage with the article and to retain the article between the finger of the carrier member and the gripping block.

The second spring biasing member is engaged with the pivot axle and includes a first end engaged with the gripping block, and includes a second end engaged with the carrier member for biasing and forcing the gripping block to engage with the article.

The gripping block includes a depression formed therein for receiving and engaging with the first end of the second spring biasing member. The carrier member includes a stop extended therefrom for engaging with the second end of the second spring biasing member.

The gripping block includes a recess formed therein for selectively receiving and engaging with the stop of the carrier member and for limiting the gripping block to rotate relative to the carrier member.

The gripping block includes a curved engaging surface for selectively engaging with the article. The gripping block includes a gripping portion having a serrated surface formed therein for frictionally engaging with the article. The finger of the carrier member includes a serrated surface formed therein for frictionally engaging with the article.

The base includes an engaging channel formed therein, and an attaching member includes a latch device engaged with the engaging channel of the base for anchoring and securing the latch device and the attaching member to the base.

The base includes a latching notch formed therein and communicative with the channel of the base, and the latch device includes a catch for engaging with the latching notch of the base and for retaining and securing the latch device and the attaching member to the base.

The base includes a locking slot formed therein and communicative with the channel of the base, and the latch device includes a latch member for selectively engaging with the locking slot of the base and for anchoring the latch device and the attaching member to the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
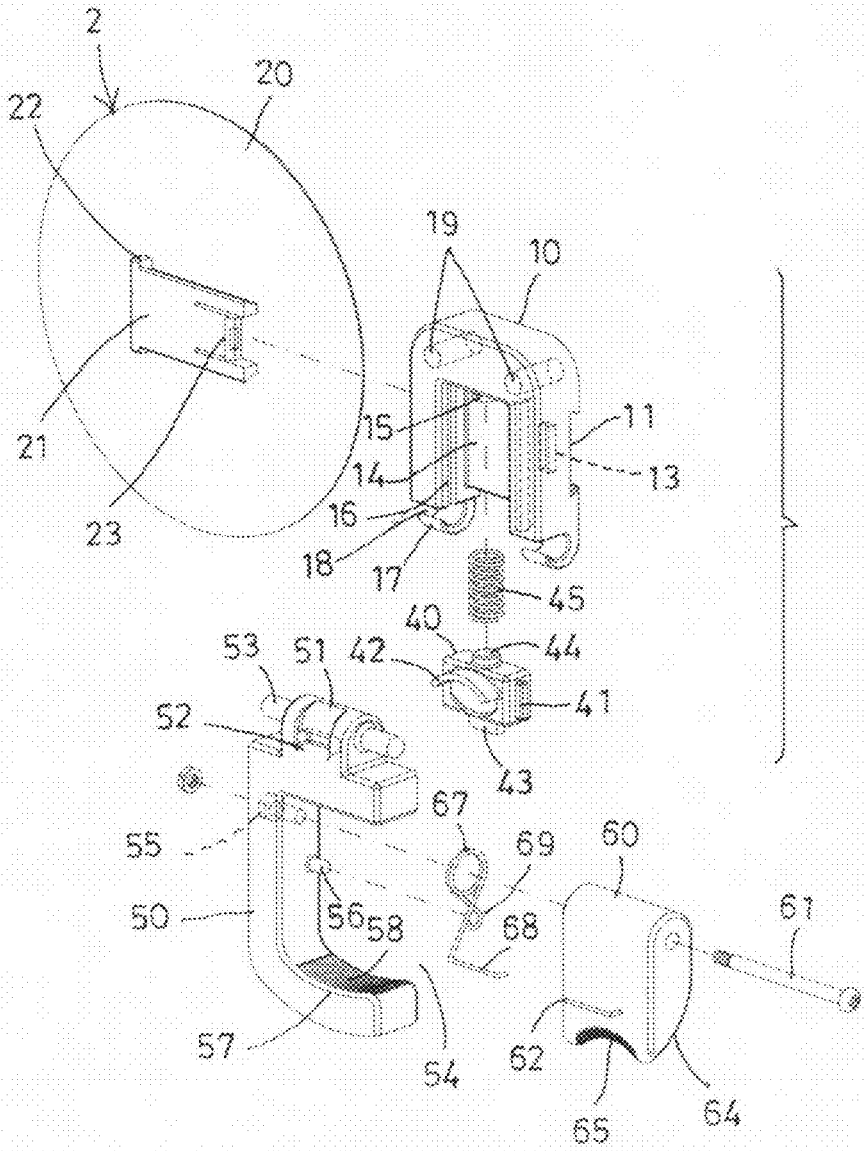
FIG. 1 is an exploded view of an article holder in accordance with the present invention.
Figure 2:
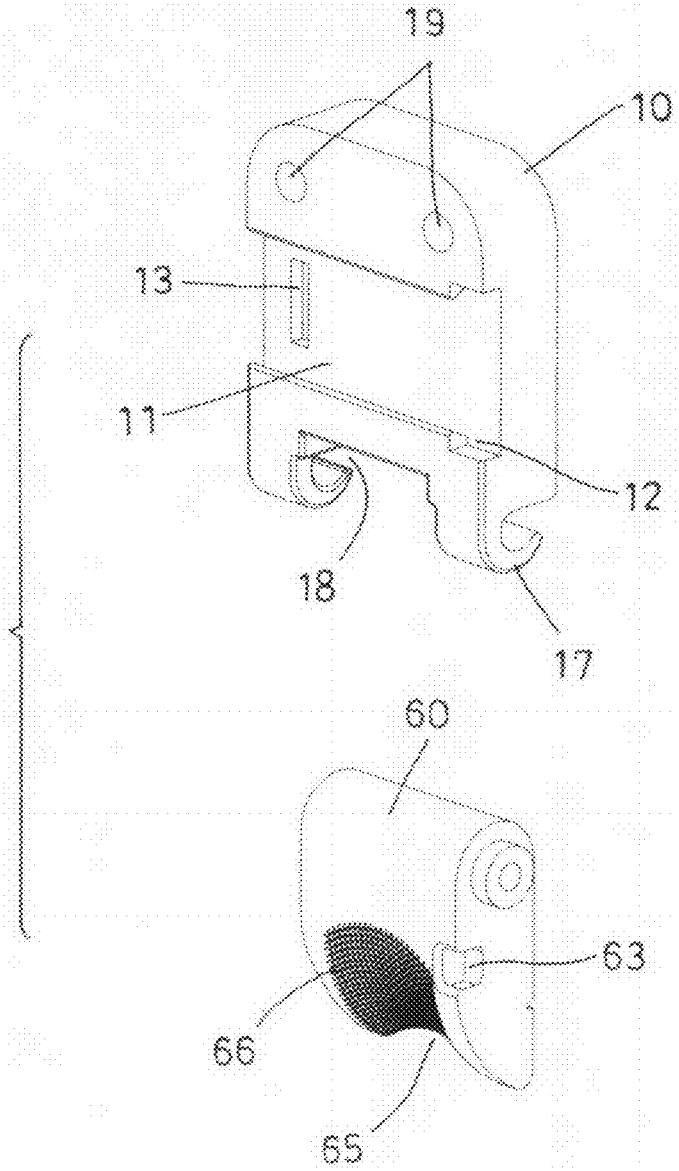
FIG. 2 is a partial exploded view of the article holder.
Figure 4:
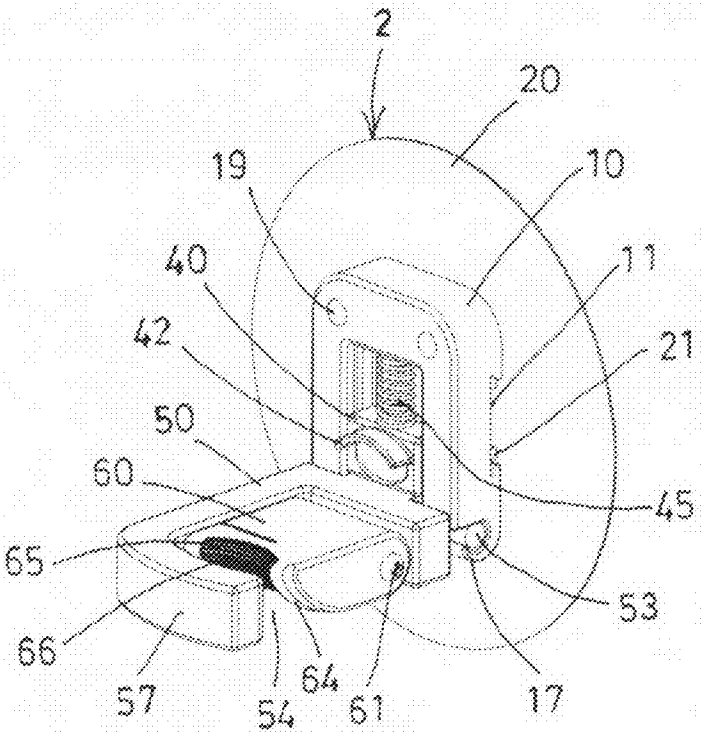
FIG. 4 is another perspective view similar to FIG. 3, illustrating the operation of the article holder.
Figure 3:
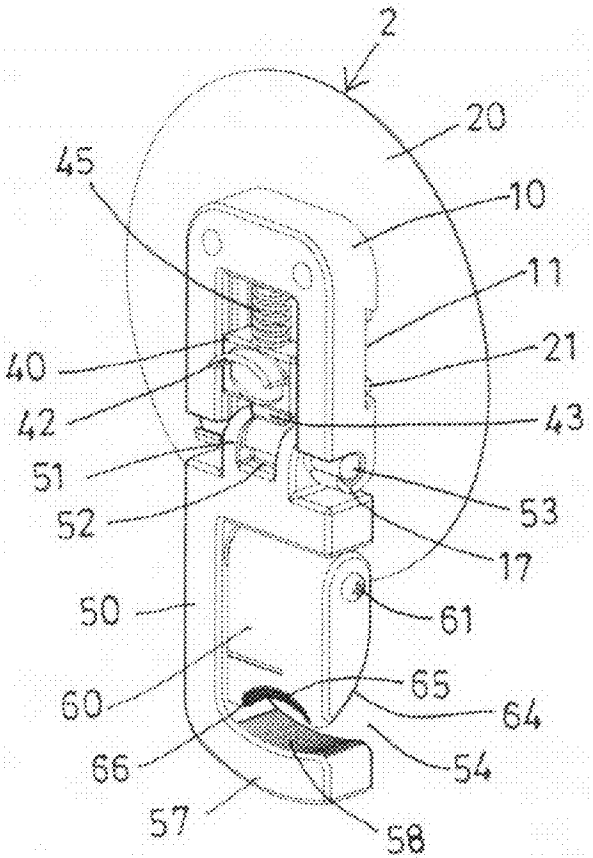
FIG. 3 is a perspective view of the article holder.
Figure 6:
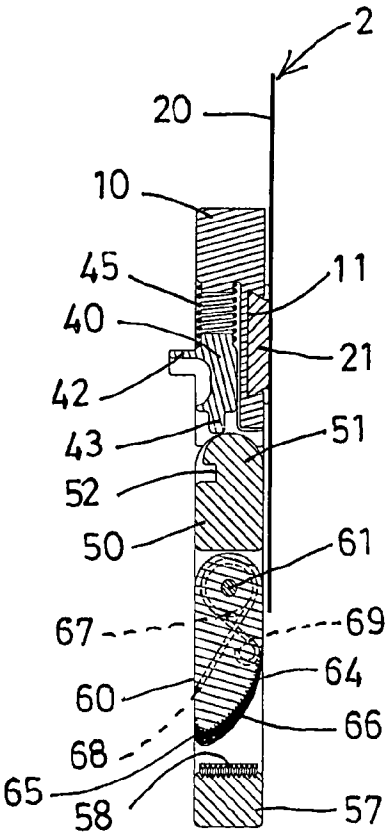
FIG. 6 is a cross sectional view of the article holder taken along lines 6-6 of FIG. 5.
Figure 5:
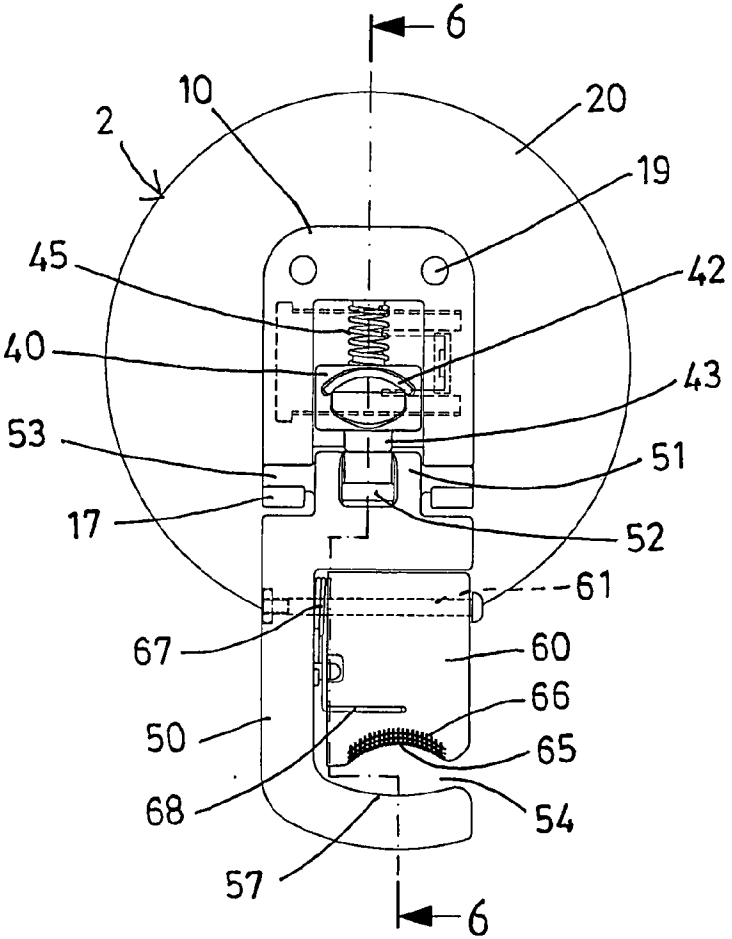
FIG. 5 is a front plan schematic view of the article holder.

Referring to the drawings, and initially to FIGS. 1-6, an article holder in accordance with the present invention comprises a receptacle or housing or base 10 including a dovetail or engaging channel 11 formed in the rear or back portion thereof, and including an enlarged latching notch 12 also formed in the rear or back portion thereof and communicative with the channel 11 of the base 10, and including a locking slot 13 also formed in the rear or back portion thereof and communicative with the channel 11 of the base 10, and including a chamber 14 formed therein and opened downwardly, and including a projection or stud 15 extended downwardly into the upper portion of the chamber 14 of the base 10, and including one or more (such as two) opposite tracks or grooves 16 formed therein and communicative with the channel 11 of the base 10, and including one or more (such as two) attachments or hooks or ears 17 extended downwardly therefrom and each having an opening 18 formed therein.

An attaching or mounting device 2 is provided for attaching or mounting the base 10 of the article holder to various support devices or facilities or wall members or supporting surfaces 9 (FIGS. 7-14), for example, as shown in FIGS. 1 and 3-12, the mounting device 2 may be selected from or may include a sucker device or attaching film or membrane or member 20 which may be made of thermoplastic materials, such as styrene butadiene styrene block copolymer or thermoplastic elastomer (SEBS) or the like, and may include a dovetail or latch member or device 21 attached or mounted or coupled or secured to the attaching member 20 for slidably engaging with the engaging channel 11 of the base 10, the latch device 21 includes a protruded catch 22 for selectively engaging with the latching notch 12 of the base 10 and for anchoring or securing or retaining the latch device 21 and the attaching member 20 to the base 10. The latch device 21 may further include a spring lock or tongue or latch member 23 for selectively engaging with the locking slot 13 of the base 10 and for further anchoring or securing or retaining the latch device 21 and the attaching member 20 to the base 10.

Figure 13:
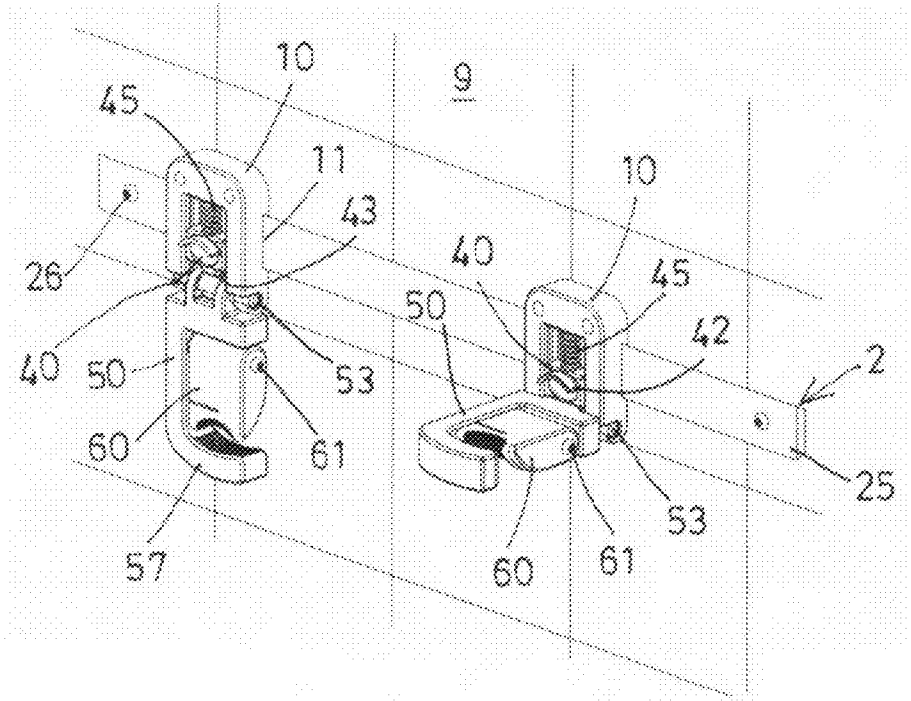
FIGS. 13, 14 are the other perspective views similar to FIG. 12, illustrating the attachment or mounting of the article holder to the supporting walls or members or surfaces.
Figure 14:
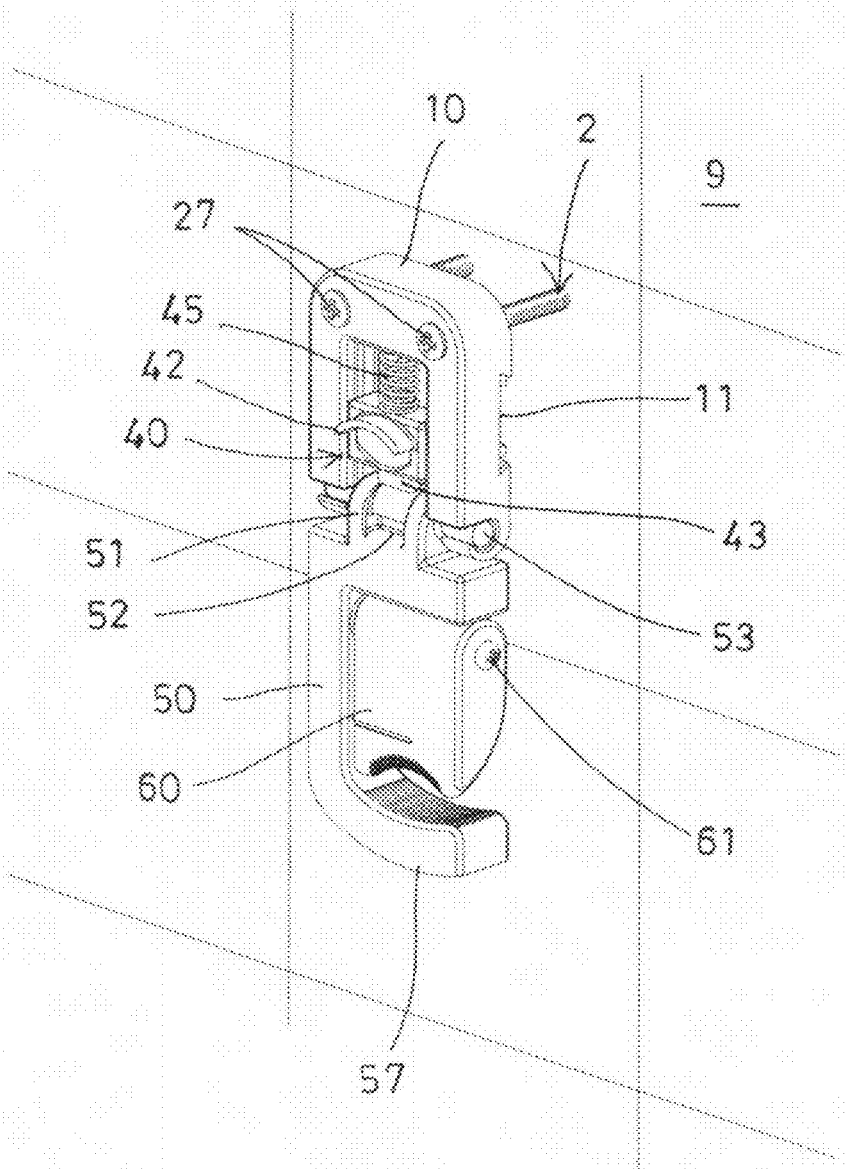

Alternatively, as shown in FIG. 13, the mounting device 2 may be selected from or may include a dovetail or rail 25 attached or mounted or secured to the wall members or supporting surfaces 9 with one or more latches or fasteners 26 for slidably receiving or engaging with or attaching or mounting the engaging channel 11 of the base 10 and for allowing one or more bases 10 to be slidably and selectively and adjustably attached or mounted or secured to the wall members or supporting surfaces 9 with the rail 25. Further alternatively, as shown in FIG. 14, the base 10 may include one or more holes or orifices 19 formed therein, and the mounting device 2 may be selected from or may include one or more latches or fasteners 27 for engaging with the orifices 19 of the base 10 and for attaching or mounting or securing or retaining the base 10 of the article holder to various supporting surfaces 9.

The article holder includes a sliding member or follower 40 slidably received or engaged in the chamber 14 of the base 10, and the follower 40 includes one or more (such as two) keys or projections 41 extended oppositely and outwardly therefrom for slidably engaging with the grooves 16 of the base 10 and for limiting and guiding the follower 40 to slide up and down along the chamber 14 of the base 10 and for preventing the follower 40 from being disengaged from the base 10, and includes a knob or hand grip 42 extended outwardly therefrom for moving the follower 40 relative to or along the base 10, and includes a latching tongue 43 extended outwardly or downwardly therefrom, and includes another projection or stud 44 extended outwardly or upwardly therefrom, and a spring biasing member 45 is engaged between the base 10 and the follower 40 and engaged with the projections or studs 15, 44 of the base 10 and the follower 40 for biasing the follower 40 to move downwardly or away from the stud 15 of the base 10.

Figure 7:
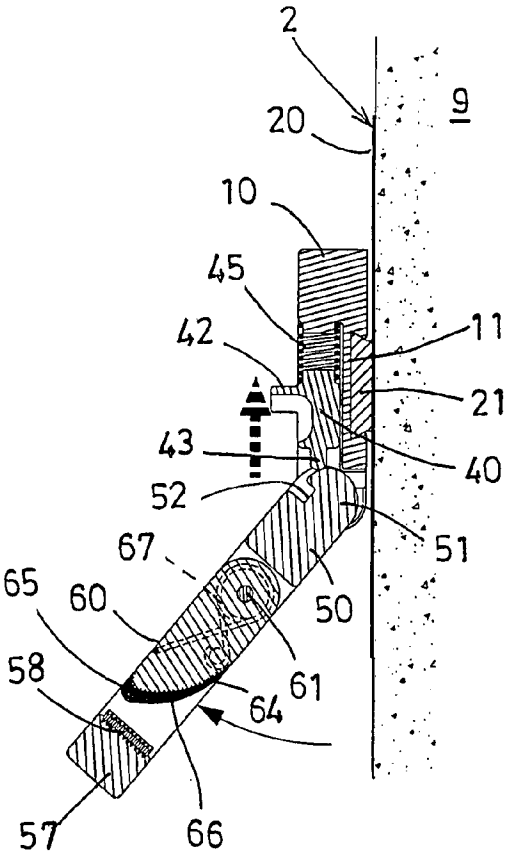

The article holder further includes a carrier arm or member 50 having a bulge or protrusion 51 extended outwardly or upwardly therefrom for engaging into the chamber 14 of the base 10, and includes a pivot shaft 53 extended from the protrusion 51 and engaged through the openings 18 of the ears 17 of the base 10, and engaged into the ears 17 of the base 10 for pivotally or rotatably attaching or mounting the carrier member 50 to the base 10 and for allowing the carrier member 50 to be pivoted or rotated relative to the base 10. The carrier member 50 includes an engaging recess or cavity 52 formed therein for selectively engaging with the latching tongue 43 of the follower 40 (FIGS. 8 and 10-11) and for selectively or adjustably anchoring or retaining the carrier member 50 to the base 10 at the selected angular position, such as at the tilted or working position where the carrier member 50 is perpendicular to the base 10. The carrier member 50 may be pivoted or rotated relative to the base 10 to a folding or storing position where the carrier member 50 is in line with the base 10 (FIG. 6) when the latching tongue 43 of the follower 40 is disengaged or detached from the engaging recess or cavity 52 of the carrier member 50 (FIGS. 7, 9).

The carrier member 50 further includes an opening or space 54 formed therein for forming or defining a U or C-shaped structure and for forming or defining an outer finger 57, and includes an aperture 55 laterally formed therein and intersected or communicative with the space 54 of the carrier member 50 for receiving or engaging with a fastener or pivot axle 61, and includes a key or projection or stop 56 extended therefrom, such as extended into the space 54 of the carrier member 50, it is preferable that the finger 57 includes a serrated surface 58 formed therein for selectively and frictionally engaging with the tool member or object or article 80 (FIGS. 10-12) that is to be attached or mounted or secured to and carried or supported by the carrier member 50 of the article holder.

Figure 11:
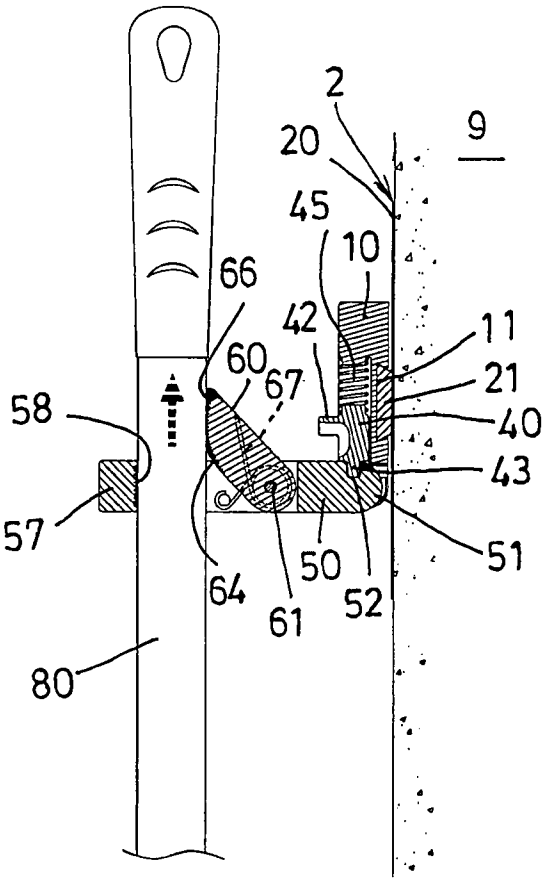
Figure 10:
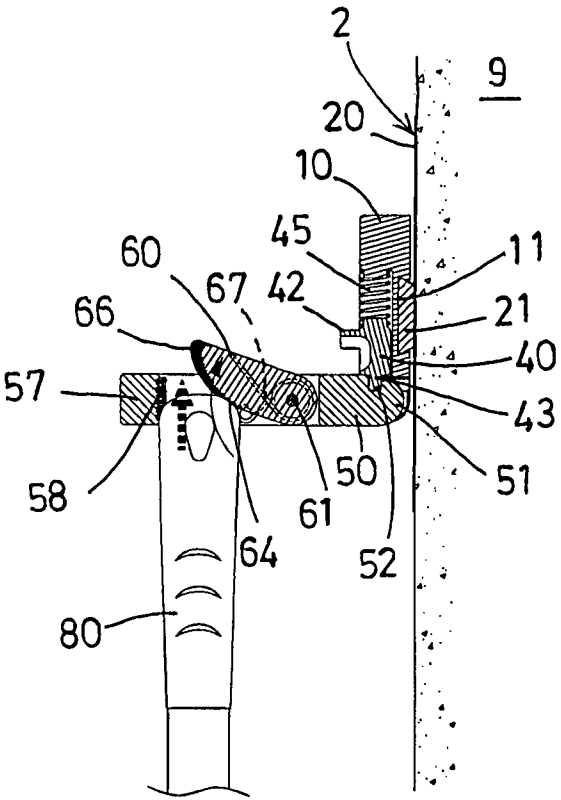

A cam-horn or pawl or clamping or grasping or gripping block 60 is pivotally or rotatably received or engaged in the space 54 of the carrier member 50, and pivotally or rotatably attached or mounted or secured to the carrier member 50 with the pivot axle 61, and includes a depression 62 formed therein, and includes a recess 63 formed therein for selectively receiving or engaging with the stop 56 of the carrier member 50 and for determining or controlling or guiding or limiting the gripping block 60 to pivot or rotate relative to the carrier member 50, and includes a curved engaging surface 64 for selectively engaging with the tool member or object or article 80 and for allowing the article 80 to be easily moved and engaged between the finger 57 of the carrier member 50 and the gripping block 60 (FIGS. 10, 11).

For example, the gripping block 60 may include a gripping surface or segment or portion 65 having a serrated surface 66 formed therein for selectively and frictionally engaging with the tool member or object or article 80. Another spring biasing member 67 is further provided and attached or mounted or engaged with the pivot axle 61 and engaged between the carrier member 50 and the gripping block 60. For example, the spring biasing member 67 includes one end 68 engaged with the depression 62 of the gripping block 60, and another end 69 engaged with the stop 56 of the carrier member 50 for biasing or forcing the gripping block 60 to engage with the stop 56, or for biasing or forcing the gripping block 60 to selectively engage with the article 80.

Figure 8:
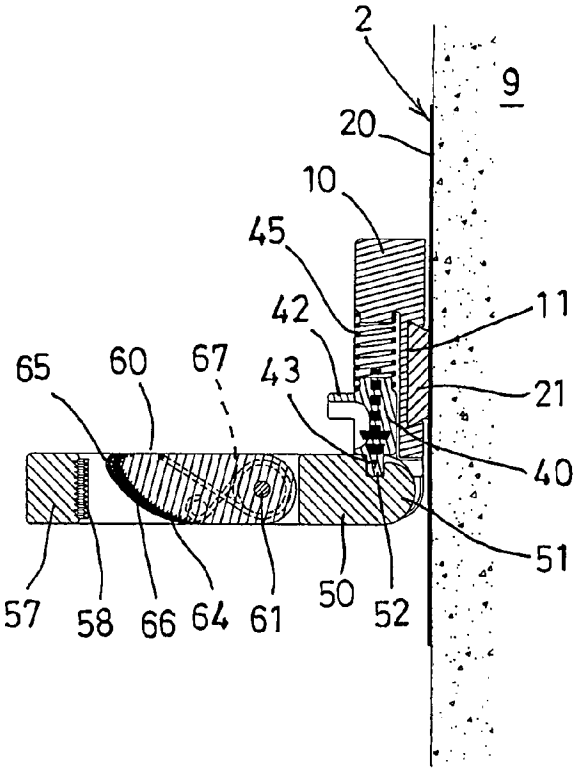
FIGS. 7, 8, 9, 10, 11 are cross sectional views similar to FIG. 6, illustrating the operation of the article holder.
Figure 9:
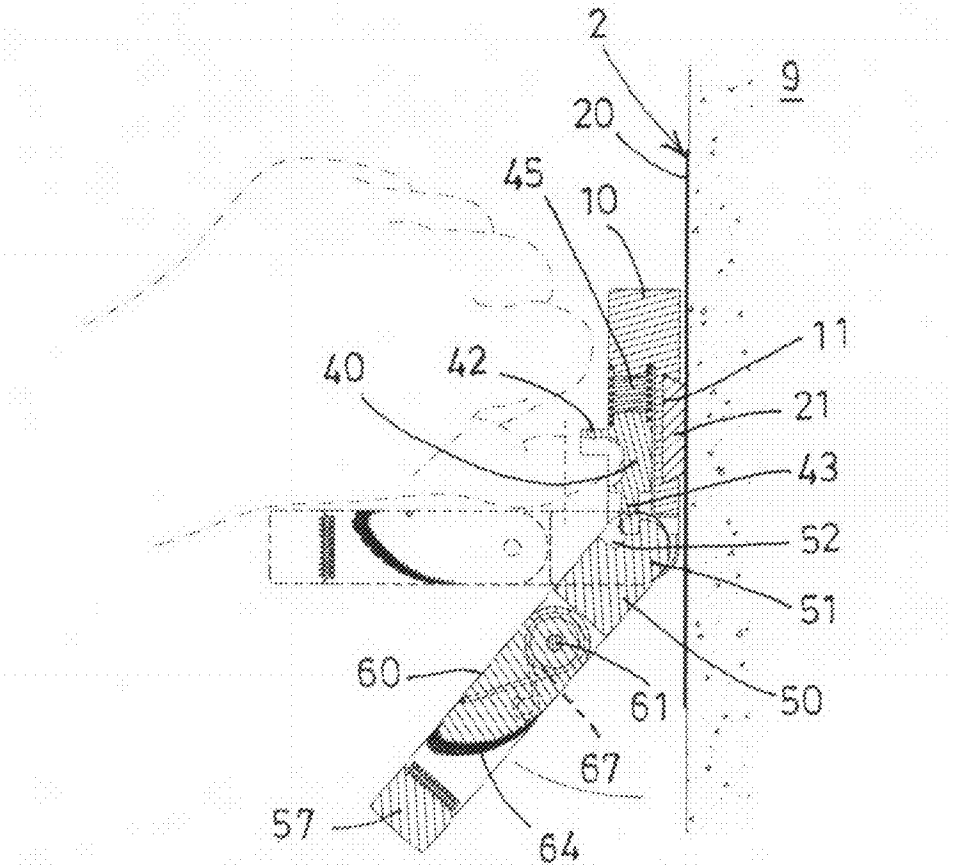
Figure 12:
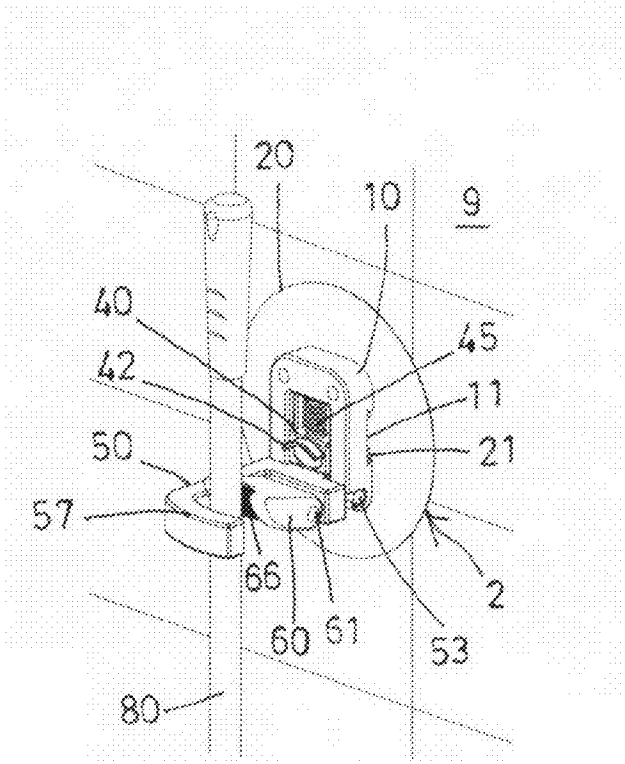
FIG. 12 is a perspective view illustrating the operation of the article holder.

In operation, when it is required to hang or hold or support the tool member or object or article 80 with the article holder in accordance with the present invention, the carrier member 50 may be pivoted or rotated relative to the base 10 (FIG. 7) from the folding or storing position where the carrier member 50 is in line with the base 10 (FIGS. 3, 5-6) to the working position where the carrier member 50 is perpendicular to the base 10 (FIGS. 4, 8, 10-12), until the latching tongue 43 of the follower 40 is engaged with the engaging recess or cavity 52 of the carrier member 50 (FIG. 8). The tool member or object or article 80 may then be easily moved and engaged with the curved engaging surface 64 of the gripping block 60 and engaged into the space or gap that is formed or defined between the finger 57 of the carrier member 50 and the gripping block 60 (FIGS. 10, 11), and may then be stably or solidly clamped or grasped or gripped between the finger 57 of the carrier member 50 and the gripping block 60 with the serrated surfaces 58, 66 that may be made of soft or resilient rubber materials or thermoplastic materials (FIGS. 11, 12). The spring biasing member 67 may bias or force the gripping block 60 to engage with the article 80, such that the article 80 may be easily and quickly secured or attached or mounted to the article holder.

Accordingly, the article holder in accordance with the present invention includes a ratchet engaging or retaining mechanism for stably or solidly engaging with the articles or tool members to be held and supported by the article holder and for allowing the articles or tool members to be easily and quickly secured or attached or mounted to the article holder and to be easily and quickly disengaged or detached from the article holder, and includes a foldable structure for allowing the articles or tool members further to be easily and quickly secured or attached or mounted to the article holder.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An article holder comprising:

a base including a chamber formed therein and opened downwardly, and including two opposite grooves formed therein and communicative with a channel of said base, and including two ears extended therefrom and each having an opening formed therein, a follower slidably engaged in said chamber of said base, and including two projections extended therefrom for slidably engaging with said grooves of said base and for limiting and guiding said follower to slide along said chamber of said base, and including a hand grip extended therefrom, and including a latching tongue extended therefrom, a carrier member including a protrusion extended therefrom for engaging into said chamber of said base, and including a pivot shaft extended from said protrusion and engaged through said openings of said ears of said base, and engaged into said ears of said base for pivotally mounting said carrier member to said base, and including an engaging cavity formed therein, said carrier member including a space formed therein and defined by a finger, a first spring biasing member engaged in said chamber of said base, and engaged between said base and said follower for biasing said follower toward said protrusion of said carrier member, and for forcing said latching tongue of said follower to selectively engage with said engaging cavity of said carrier member, and for selectively anchoring and retaining said carrier member to said base at a working position, said carrier member being allowed to be pivoted relative to said base to a storing position where said carrier member is in line with said base when said latching tongue of said follower is disengaged from said engaging cavity of said carrier member, a gripping block engaged in said space of said carrier member and pivotally attached to said carrier member with a pivot axle, and including a gripping portion for selectively engaging with an article, and a second spring biasing member engaged with said gripping block for biasing said gripping block to engage with the article and to retain the article between said finger of said carrier member and said gripping block.

2. The article holder as claimed in claim 1, wherein said second spring biasing member is engaged with said pivot axle and includes a first end engaged with said gripping block, and includes a second end engaged with said carrier member for biasing and forcing said gripping block to engage with the article.

3. The article holder as claimed in claim 2, wherein said gripping block includes a depression formed therein for receiving and engaging with said first end of said second spring biasing member.

4. The article holder as claimed in claim 2, wherein said carrier member includes a stop extended therefrom for engaging with said second end of said second spring biasing member.

5. The article holder as claimed in claim 4, wherein said gripping block includes a recess formed therein for selectively receiving and engaging with said stop of said carrier member and for limiting said gripping block to rotate relative to said carrier member.

6. The article holder as claimed in claim 1, wherein said gripping block includes a curved engaging surface for selectively engaging with the article.

7. The article holder as claimed in claim 1, wherein said gripping block includes a gripping portion having a serrated surface formed therein for frictionally engaging with the article.

8. The article holder as claimed in claim 1, wherein said finger of said carrier member includes a serrated surface formed therein for frictionally engaging with the article.

9. The article holder as claimed in claim 1, wherein said base includes an engaging channel formed therein, and an attaching member includes a latch device engaged with said engaging channel of said base for anchoring and securing said latch device and said attaching member to said base.

10. The article holder as claimed in claim 9, wherein said base includes a latching notch formed therein and communicative with said channel of said base, and said latch device includes a catch for engaging with said latching notch of said base and for retaining and securing said latch device and said attaching member to said base.

11. The article holder as claimed in claim 9, wherein said base includes a locking slot formed therein and communicative with said channel of said base, and said latch device includes a latch member for selectively engaging with said locking slot of said base and for anchoring said latch device and said attaching member to said base.

* * * * *